US005876079A

United States Patent [19]

Rycroft

[11] Patent Number: 5,876,079

[45] Date of Patent: Mar. 2, 1999

[54] WASTE REMOVAL DEVICE

[75] Inventor: David Rycroft, Sumner, New Zealand

[73] Assignee: Pugon Ltd., Christchurch, New Zealand

[21] Appl. No.: 826,274

[22] Filed: Mar. 27, 1997

[30] Foreign Application Priority Data

| | | | |
|---|---|---|---|
| Jul. 4, 1996 | [NZ] | New Zealand | 286938 |
| Jul. 29, 1996 | [NZ] | New Zealand | 29908 |

[51] Int. Cl.[6] ..... A01K 29/00; E01H 1/12

[52] U.S. Cl. ..... 294/1.3; 294/2

[58] Field of Search ..... 294/2, 3, 1.3–1.5, 294/16, 118; 15/104.8, 105, 257.1, 257.6; 119/161, 792, 795, 801

[56] References Cited

U.S. PATENT DOCUMENTS

| | | | |
|---|---|---|---|
| D. 240,838 | 8/1976 | Nitu | 294/1.3 X |
| 3,560,039 | 2/1971 | Gruber | 294/1.3 |
| 3,778,097 | 12/1973 | Dorzan . | |
| 3,813,121 | 5/1974 | Marvin . | |
| 4,215,887 | 8/1980 | Boots . | |
| 4,273,370 | 6/1981 | Kjaer | 294/1.3 |
| 5,186,506 | 2/1993 | Gale . | |
| 5,385,376 | 1/1995 | Malaspina et al. | 294/1.3 |
| 5,409,279 | 4/1995 | Magee . | |

FOREIGN PATENT DOCUMENTS

| | | | |
|---|---|---|---|
| 8700672 | 10/1989 | Belgium . | |
| 584040 | 2/1994 | European Pat. Off. | 294/1.3 |
| 3301761 | 8/1984 | Germany | 294/1.3 |
| 4007051 | 9/1991 | Germany | 294/1.3 |
| 4008295 | 10/1991 | Germany | 294/1.3 |
| 8901465 | 1/1991 | Netherlands | 294/1.3 |
| 651873 | 10/1985 | Switzerland | 294/1.3 |

*Primary Examiner*—Johnny D. Cherry
*Attorney, Agent, or Firm*—Merchant, Gould, Smith, Edell, Welter & Schmidt, P.A.

[57] ABSTRACT

The invention provides for an animal waste removal device constructed from two stirrup-shaped components hinged at an apex of the stirrup. Each of the members forming the waste removal device incorporates an end element. The end elements may be shaped so that when the waste removal device is in the closed position, a storage receptacle is formed therein. The storage receptacle may be used to store plastic bags for use in disposing of the waste. To access the plastic bags, the hinged components are moved apart and a plastic bag withdrawn. The waste removal device may also be used as a leash handle by connecting a leash to the apex portion of the closed device.

6 Claims, 4 Drawing Sheets

WASTE REMOVAL DEVICE

TECHNICAL FIELD

The present invention relates to devices and methods for removing waste from the ground or other surfaces. More particularly, although not exclusively, the present invention relates to a combined animal excrement remover and leash handle which is particularly suitable for use with dogs and incorporates disposal containers stored within the device.

The present invention may be used for removing or picking up waste which would normally be undesirable or unhygienic to touch. The following discussion is in the context of animal waste. However, this is not to be considered as a limiting application.

BACKGROUND TO THE INVENTION

Animal waste removers are colloquially known as "pooper-scoopers". For brevity, this terminology will be used in the following discussion and description.

To the present time, a number of different pooper-scoopers are known. The simplest is in the form of a shovel sometimes located at the end of rod or stick. The waste is scraped into the shovel where it is placed in a disposal receptacle or waste bin. Other designs include those constructed in the form of a handle and clasping jaw located at either end of a stick or rod. In use, the animal owner scrapes the offending material into the jaws or mouth of the pooper-scooper wherein the handle is actuated to pick up or retain the animal excrement.

The action removes the material from the ground and holds it until it can be placed or shaken into a rubbish bin or other receptacle. Such devices can be bulky and require the animal owner to carry the device for the sole purpose of removing animal excrement. Further, the shovel or jaw makes contact with the waste thus posing a potential health hazard to the user. Also, the remote "jaw" type action in the case of the clasping jaw constructions can be ineffective and not completely remove the material from the ground or other surface.

The need for an effective "user friendly" device is further illustrated by the fact that many regional authorities have deemed it an offense, in some form or another, for pet owners to leave their animal's excrement in a public place. Accordingly, an animal owner in some jurisdictions is bound, by law, to clean up after their animal.

Therefore, there exists a need for a compact "user friendly" pooper-scooper which at least mitigates the above-mentioned disadvantages or at least provides the public with a useful choice. It is a further object to provide a hygienic waste removal device for general use.

DISCLOSURE OF THE INVENTION

In one aspect the invention provides for a waste removal device including:

first and second members pivotally connected together, said first and second members incorporating first and second jaw portions respectively, said pivotal connection being located so that when first and second distal ends of the first and second members are moved together, the first and second jaw portions engage or close on each other.

The first and second members are preferably shaped so that when the first and second jaw portions are in the closed position, the device can be used as a leash handle wherein a leash may be connected to the distal ends of either the first or second members.

In a preferred embodiment, the first and second members each comprise:

a pair of arms bent so as to form, when attached to an elongate end member a generally stirrup shaped component, the first and second members being joined at the apex of the stirrup by a hinge means and are located in a relative disposition so that they are capable of relative rotation around the hinge means so that when the first and second members are in the closed position, a leash handle is formed.

In a preferred embodiment the elongate end member of either the first or second members may be formed into a receptacle in which one or more disposal means can be stored, said receptacle being accessible when the first and second members are in the open position.

In a preferred embodiment, the stirrup shaped handle incorporates a hand grip formed by the storage receptacle and/or elongate end member(s) wherein the hand grip is attached to the component and the leash is secured to an attachment means located at the apex of the stirrup shaped handle.

In a preferred embodiment, the first and second members are shaped so that the first member fits within the second member and the first member's elongate end member forms the storage receptacle which is closed by the elongate end member of the second member when the first and second members are located one within the other.

Preferably the first or second member incorporates a means by which a leash or similar animal attachment/control means may be attached thereto so that when the first and second members are hinged together in the closed position, the resulting article may be used as a leash handle.

In an alternative embodiment, the first and second members may be injection moulded from plastic and joined by means of a flexible web at the apex of the stirrup.

The first and second members may by spring or otherwise biased so that they are naturally oriented in the open position.

In a further embodiment, either the first or second member may incorporate a detent which holds the first and second member, when closed, together in fixed relation.

In an alternative embodiment, each of the first and second members may be formed from an elongate end member and a single arm, the first and second members being hinged so as to provide the requisite jaw action.

BRIEF DESCRIPTION OF THE DRAWINGS

The invention will now be described by way of example and with reference to the drawings in which:

Referring to FIG. 4, a perspective view of an embodiment of a waste removal device of the present invention is shown. First and second members 25 and 26 respectively are hinged together by means of pins 19 and 20. As can be seen from FIG. 1, the waste removal device is generally "stirrup" or handle shaped with the hinge means located at or near the apex of the stirrup.

Figure 1:
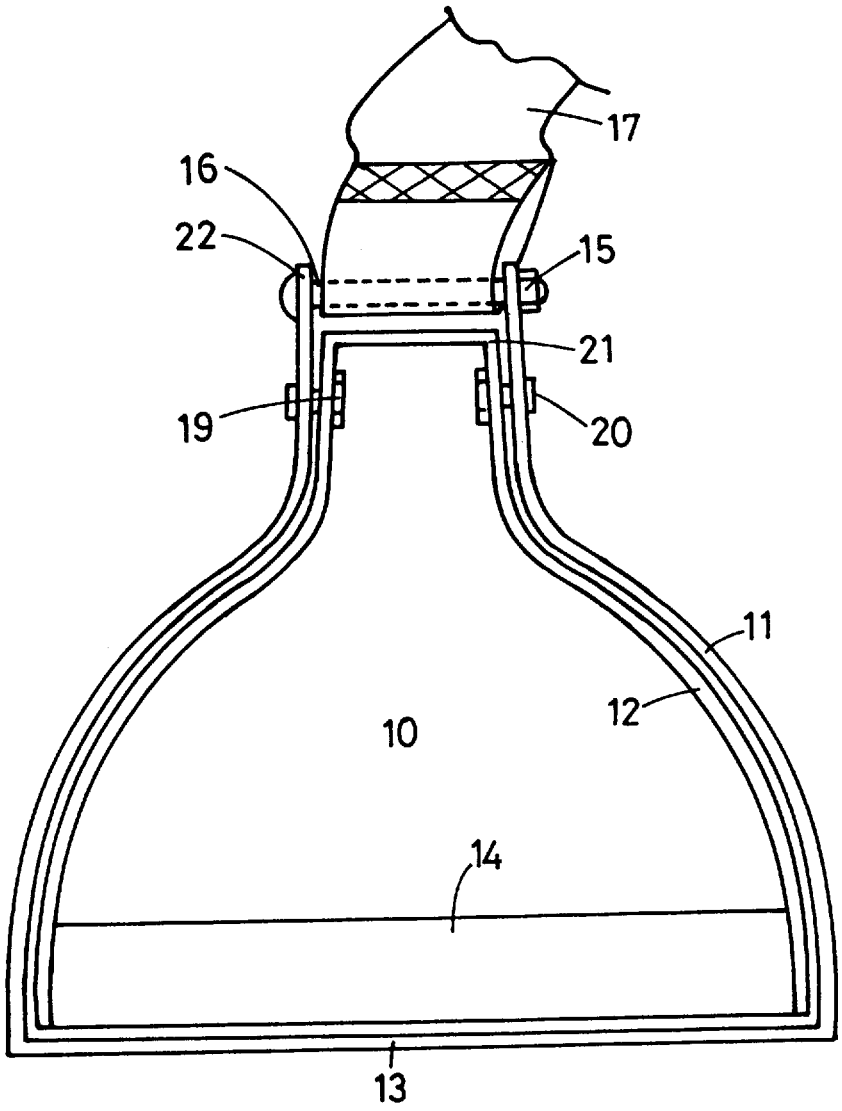
FIG. 1: Illustrates a plan view of a waste removal device when in the closed position.

Each of the first and second members 25 and 26 incorporates arms 12 and 11 respectively bent so as to form, when connected to an elongate end member 13 and 14 respectively, a handle. Alternatively, the arms may be straight and incorporate bent tabs at either end to allow their attachment, at the appropriate angle, to the pin 16 and elongate end members 13 or 14.

Figure 2:
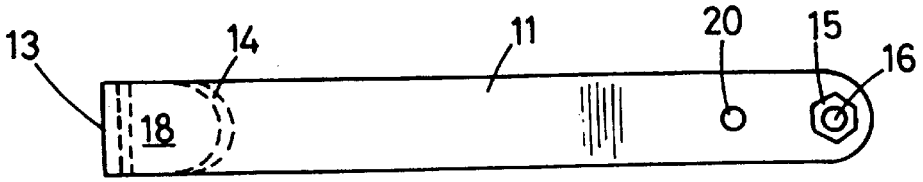
FIG. 2: Illustrates a side view of waste removal device when in the closed position
Figure 3:
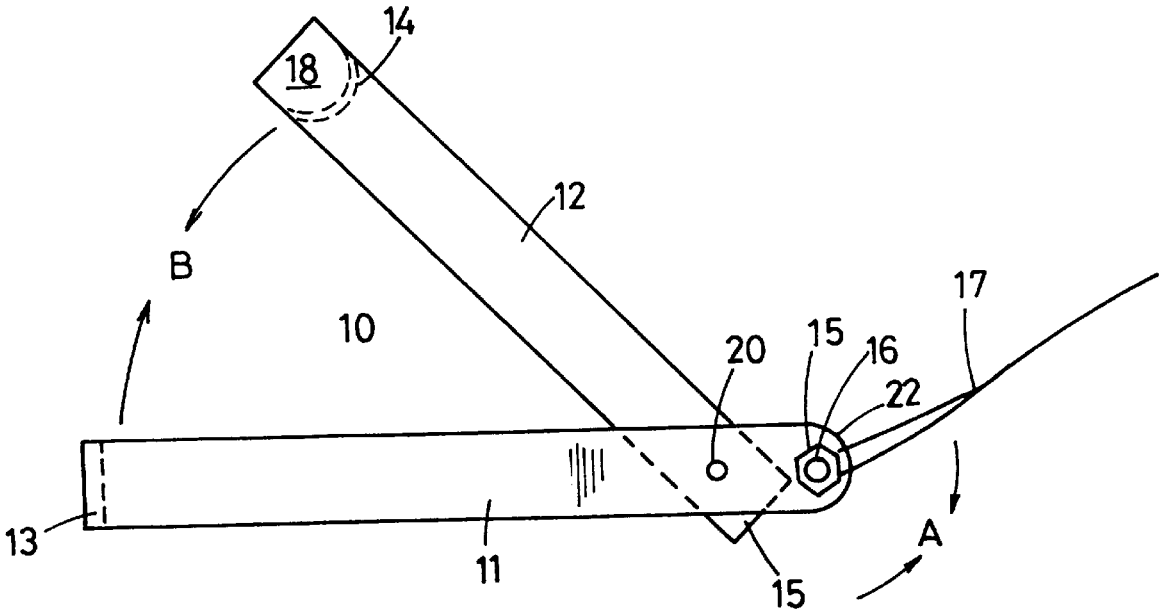
FIG. 3: Illustrates a waste removal device when hinged in the open position.

The second member 26 incorporates, in this embodiment, a location pin 16 secured by a bolt 15 which connects the apex of the arms 11. This provides a securing location where a leash 17 can be secured by threading it on to the pin 16 which is then secured by means of a bolt 15. The first member 25 pivots within the second member 26 around the hinge defined by the pins 19 and 20. The shape and geometry of the arms 12 and elongate end member 14 are such that when in the closed position, shown in side elevation in FIG. 2, the first member 25 is located within the second member 26, the second member comprising arms 11 and elongate end member 13.

Jaw portions are defined by the elongate end portions 13 and 14 and the arm portions 11, 12 which form the 'mouth' or open jaw when the device is in the open position. This is most clearly seen in FIGS. 4 and 5.

The elongate end member 14 also forms, in this embodiment, a receptacle 18, in which one or more disposal means may be stored. In the particular example described, a number of plastic disposal bags are tightly folded and inserted into the receptacle 18. The receptacle is closed when the first and second members 25 and 26 respectively are in the closed position whereby the elongate end member 13 is brought to bear against the open end of the receptacle 18.

The particular embodiment described herein is constructed from flat aluminum strips (for example 11 and 12). Such a construction and material are not to be construed as limiting as the first and second members could equally be made from injection moulded plastics and be of a different shape in cross section and be made to 'nestle' the first and second member within each other or otherwise join to form the handle. One of the essential aspects is that a user is provided with an device which can be used as a handle for an animal leash as well as a jaw or pincer type mechanism which can be used to pick up waste material as will be discussed further below. It is a further advantage that the disposal means (plastic bags in this example) are carried integrally with the device.

As noted above, when the article shown in FIGS. 1 to 5 is being used as a leash handle, the first and second members 25 and 26 are rotated into the closed position and the user grasps the hand grip formed by the elongate members 14 and 13. If the receptacle is omitted, the hand grip is formed by two members similar to elongate member 13.

When waste material is encountered, the user rotates the first and second members 25 and 26 into the open position and removes a folded disposal bag from the receptacle 18. The receptacle 18 can store approximately 5 to 6 disposal bags depending on their thickness and dimensions. Other bag materials are envisaged such as paper or similar biodegradable material.

Figure 4:
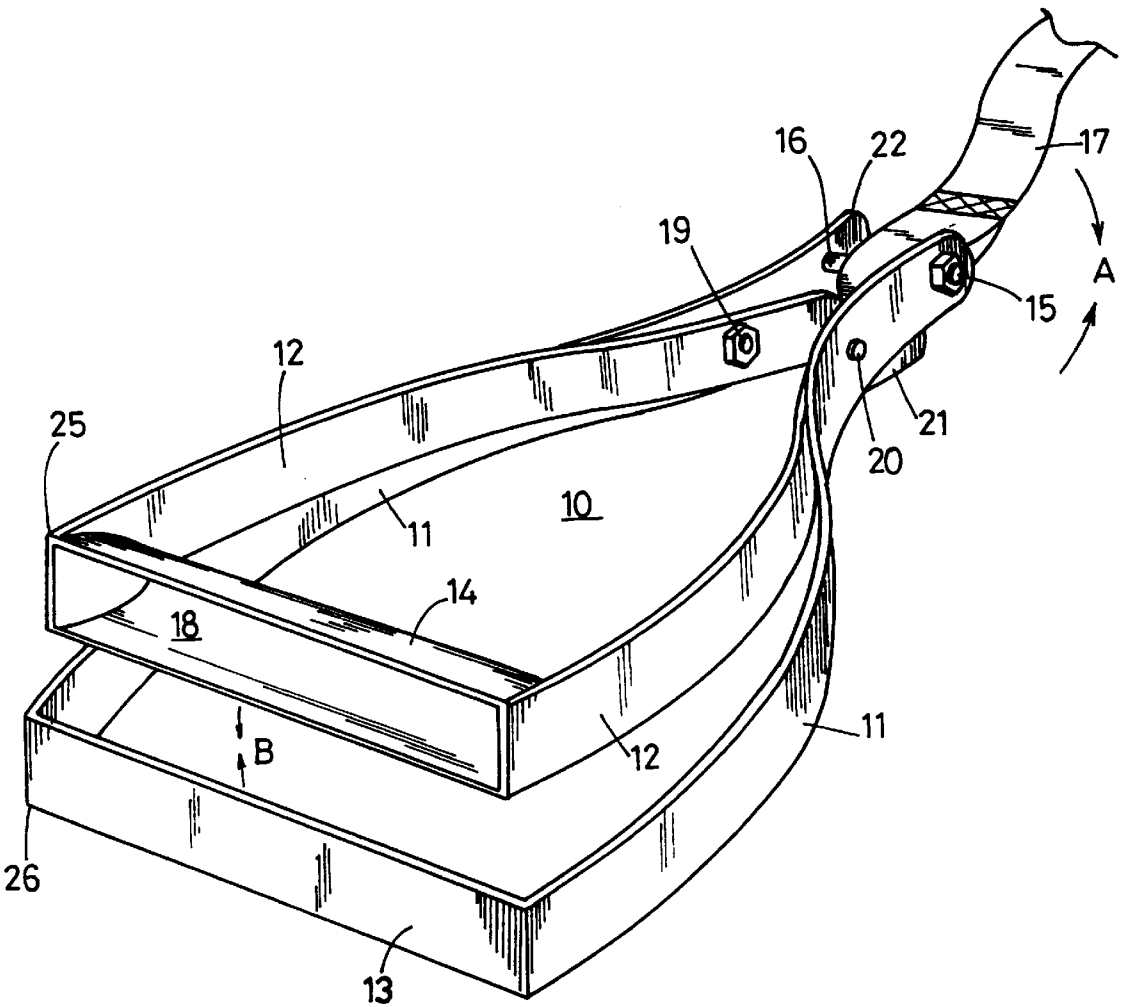
FIG. 4: Illustrates a perspective view of a waste removal device when in the open position.
Figure 5:
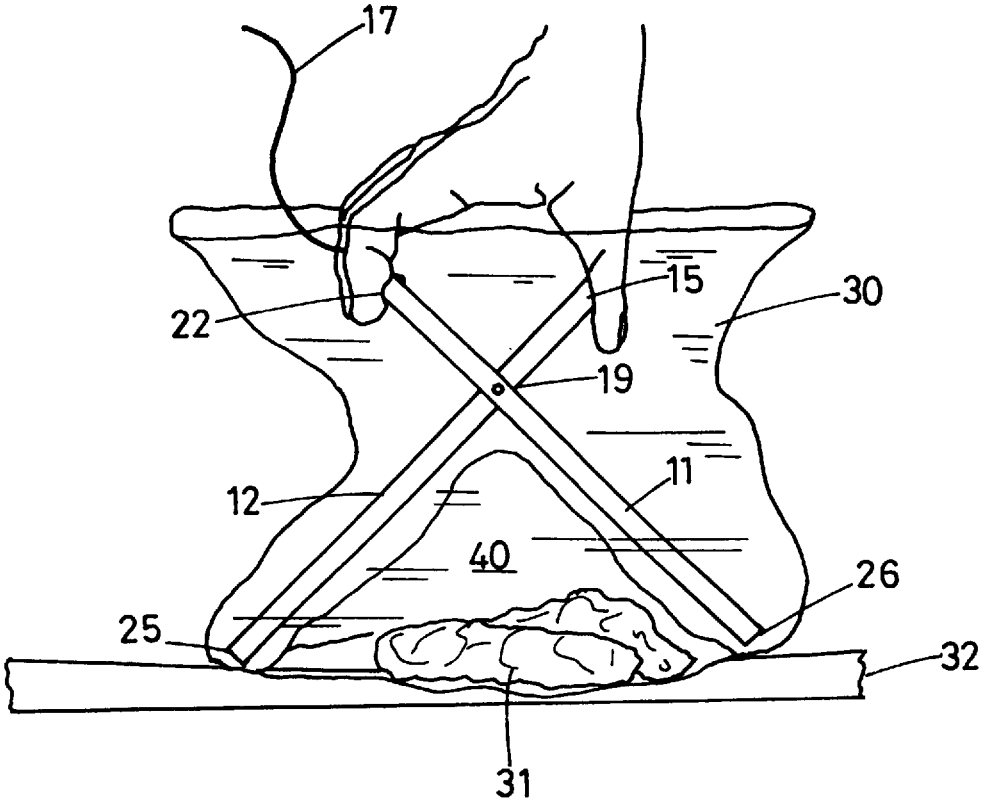
FIG. 5: Illustrates a method of using the waste removal device.

Once the disposal bag 30 is removed, it is unfolded and the open waste disposal device 10 is placed in the bag 30. A cavity 40 is formed either by the user or when the device and bag are placed over the waste. The user holds the waste disposal device at its' apex as shown in FIG. 5. The length of the arms protruding beyond the hinge point (near the user's fingers) is slightly exaggerated to illustrate the levering action. Referring to FIG. 4, the user holds the opened waste removal device at points 22 and 21. With the device partially or completely inside the disposal bag 30, the open jaw portions are placed around the waste material 31 (see FIG. 5) whereupon the user exerts pressure at the points 22 and 21 thus closing the jaws portions. The waste 31 is thereby removed from the ground and contained in the disposal bag 30. The elongate end members 13 and 14 can be used to scrape any waste material from the surface upon which it has been deposited. When substantially all of the waste matter has been removed from the surface, the device is likely to be nearly fully closed. The user then grasps the top or opened end of the disposal bag 30 and removes the waste removal device from the bag thus turning the disposal bag 30 inside out. This encapsulates the waste material within the bag 30 as the bag 30 is turned inside out. The user can thus remove the waste material without skin contact or any intermediate stage between scraping or removing the waste material and depositing it in a collection bag. There is also no physical contact between the waste and the waste removal device itself. Thus the user can safely dispose of the waste/bag and continue to use the device as a leash handle.

Therefore it can be seen that in two steps, waste material can be removed from a surface, the waste removal device, in a collection bag, is used to grab and/or scrape the waste material from the surface whereupon the jaws are closed and the closed device is removed from the bag thus turning it inside out. Once the pressure is released from the points 21 and 22 the jaw portions open slightly to release the bag/waste. The user is left holding the still clean waste removal device in one hand and a closed disposal bag containing the waste material in the other.

It has been found that the present method in conjunction with the new waste removal device provides a clean, effective and non-contact method of removing waste material where the device doubles as a leash handle. Further, the device conveniently carries the disposal means (plastic bags in this example).

Either of the first or second members could incorporate a detent adapted so that when the first and second members are rotated together, the detent locks, by way of friction, the handle in the closed position. The detent(s) (not shown) could be located at a point along any of the arms 11 or 12 or on the elongate end members 13 or 14.

While the example shown in FIG. 4 has flat sides 11 and 12, it is envisaged that other arm shapes and cross-sections could be used. The flat sides are the result of the particular prototype construction and are not to be construed in a limiting manner.

Similarly, the hinge pins 19 and 20 are located in the present embodiment, just short of the apex and leash connection pins 16. In an alternative embodiment, the hinge point could be at the extremity of the end arms 11 and 12 wherein a spring or similar biasing means could be used to hold the first and second members 25 and 26 apart whereupon a user would merely press the jaws together in order to pick up the waste material.

Such variations are considered to be within the purview of one skilled in the art and there are a number of constructional variations which are considered to be within the scope of the present invention. Such variations include injection moulding or otherwise forming the components of the handle/waste removal device, the overall shape of the device, the means by which the leash is attached to the apex of the device and the particular method by which the two components of the device are hinged.

For example, it is possible that the first and second members 25 and 26 may be formed so as to constitute half sections of the complete handle whereby the receptacle 18 is formed by both elongate end pieces 13 and 14. In this embodiment, the receptacle openings would face the interior of the jaw area and some type of friction or bias clip would hold the two components closed when the device is being used as a handle. Further, it is possible that one arm of a first and second member might be omitted thus forming an 'L' shaped handle. Such a construction could be used in a similar manner to the stirrup shaped handle.

Thus, by the present invention a convenient pooper-scooper is provided which avoids contact between the skin and the waste material. It is convenient and easy to use and in one convenient package, provides all the equipment necessary for an animal owner to clean up after their animal. While the present example has been described for use with a leash, it is possible to connect the handle to a stick or cane.

Where in the foregoing description reference has been made to elements or integers having known equivalents, then such equivalents are included as if they were individually set forth.

Although the invention has been described by way of example and with reference to particular embodiments, it is to be understood that modifications and/or improvements may be made without departing from the scope of the appended claims.

I claim:

1. A waste removal device including:

first and second members pivotally connected by means of a pivotal connection, said first and second members incorporating first and second jaw portions respectively, said pivotal connection being located so that when first and second distal ends of the first and second members are moved together, the first and second jaw portions engage or close on each other wherein the first and second members are shaped so that when the first and second jaw portions are in the closed position, the device forms a leash handle, wherein the first and second members each comprise:

a generally stirrup-shaped component formed from a pair of bent arms and joined by an elongate end member, the first and second members being joined at an apex of the stirrup-shaped component by a hinge means and the first and second members being located in a relative disposition so that they are capable of relative rotation around the hinge means.

2. A waste removal device as claimed in claim 1 wherein the elongate end member of either the first or second members is formed into a receptacle in which one or more disposal means can be stored, said receptacle being accessible when the first and second members are in the open position.

3. A waste removal device as claimed in claim 2 wherein the leash handle incorporates a hand grip formed by the storage receptacle and/or elongate end member(s) wherein the hand grip is attached to the stirrup shaped component and a leash is secured to an attachment means located at the apex of the stirrup shaped component.

4. A waste removal device as claimed in claim 2 wherein the first and second members are shaped so that the first member fits within the second member and a first elongate end member associated with the first member forms the storage receptacle which is closed by a second elongate end member associated with the second member, when the first and second members are located one within the other.

5. A waste removal device as claimed in claim 1 wherein the first or second member incorporates a means by which a leash may be attached thereto so that when the first and second members are hinged together in the closed position, the waste removal device may be used as a leash handle.

6. A waste removal device as claimed in claim 1 wherein the first and second members are injection moulded from plastic and joined by means of a hinge means at the apex of the stirrup-shaped component.

* * * * *